US006147655A

United States Patent [19]

Roesner

[11] Patent Number: 6,147,655

[45] Date of Patent: Nov. 14, 2000

[54] FLAT LOOP ANTENNA IN A SINGLE PLANE FOR USE IN RADIO FREQUENCY IDENTIFICATION TAGS

[75] Inventor: Bruce B. Roesner, San Diego, Calif.

[73] Assignee: Single Chip Systems Corporation, San Diego, Calif.

[21] Appl. No.: 09/187,024

[22] Filed: Nov. 5, 1998

[51] Int. Cl.[7] ..... H01Q 11/12

[52] U.S. Cl. ..... 343/741; 343/742; 343/866; 340/572

[58] Field of Search ..... 343/741, 742, 343/866, 867, 895; 340/572, 505, 571

[56] References Cited

U.S. PATENT DOCUMENTS

| | | | |
|---|---|---|---|
| 3,534,372 | 10/1970 | Scheuerecker et al. | 343/742 |
| 5,760,747 | 6/1998 | McCoy et al. | 343/728 |
| 5,798,688 | 8/1998 | Schfield | 340/438 |
| 5,825,291 | 10/1998 | Platt et al. | 340/572 |
| 5,914,692 | 6/1999 | Bowers et al. | 343/742 |

*Primary Examiner*—Tan Ho
*Attorney, Agent, or Firm*—Daniel L. Dawes

[57] ABSTRACT

A flat compact loop pattern provides an antenna for radio frequency identification tags with an enhanced voltage and/or current across two closely adjacently spaced terminals which are disposed on the same side of an insulating substrate. The amount of voltage supplied by the antenna loop to the RFID tag depends not only on the surface area included within the loop but also on the length of the planar loop or winding. The loop is comprised of a serpentine non-crossing wire disposed all on one side of the substrate, typically in the pattern of either a raster patterns in areas adjacent to one or more of the sides of the rectangular substrate, or a radial array of loops extending between the periphery and center of the substrate as the loops are azimuthally advanced around the center like spokes on a wheel or slices of pie.

19 Claims, 3 Drawing Sheets

FLAT LOOP ANTENNA IN A SINGLE PLANE FOR USE IN RADIO FREQUENCY IDENTIFICATION TAGS

BACKGROUND OF THE INVENTION

1. Field of the Invention

The invention relates in general to the use of a flat conductive winding as an antenna and more particularly to a serpentine planar configuration for loop antenna having a high radio frequency cross section and in which the antenna terminals are closely adjacent to each other.

2. Description of the Prior Art

Loop antennas are of course one of the first designs employed for radiofrequency circuits. For example, D. L. Hings, "Omnipole Antenna," U.S. Pat. No. 3,325,805 shows in FIGS. 3 and 4 an inductance 29 enclosed with an electrostatic shield 30 having a base plate 31. Inductance 29 includes a first, second and third coil portions 32, 33 and 34, respectively connected in a series in a general U-shape. The entire inductance 29 has first and second ends 35 and 36 which are disposed closely adjacent to base 31 of electrostatic shields 30. The three coil portions 32, 33 and 34 each have an access lying in a plane 37. Shield 30 is rectangular and sides 38 and 39 parallel to plane 37.

FIGS. 5 and 6 show another embodiment wherein an inductance 46 is part of a transformer 47. Inductance 46 includes first, second and third coils 48, 49 and 50 connected in a series. Coils 48, 49 and 50 are disposed in a single plane with coils 48 and 50 disposed perpendicular to each other and with their ends closely adjacent.

Ware, "Radio Telephoning," U.S. Pat. No. 1,627,718 (1927) shows a receiving unit equipped with a comparatively small loop antenna of a conventional type depicted in FIGS. 1 and 2. Loop 5 as shown in FIG. 1 is double with each half of the loop wound in an opposite direction. Loop 5 may be connected as indicated in the circuit with a variable tuning condenser 76 and loosely coupled through coil 77 to the input circuit of detector 51. The receiver loop is shielded from local transmitter oscillations by any suitable means, but preferably by an electrostatic open circuited shielded cage 52 shown in FIG. 3.

Shield 52 is comprised of a special form of cage or coil with conductive material adapted to surround loop 5 and spaced apart from it. The preferred construction of the cage comprises two groups of spaced, parallel conductors connected in series with one end only of each group connected to a common ground connector 52'.

De Vail, "RF Transponder System With Parallel Resonant Interrogation Series Resonant Response," U.S. Pat. No. 5,608,417 (1997) shows in FIG. 1 antenna coils 4 and 6 formed on opposite surfaces of substrate 2. Each of coils 4 and 6 are serpentine coils formed on opposite sides of substrate 2 in generally rectangular spirals as you discuss as being the prior art. Inner ends 8 and 10 of coils of 4 and 6 are connected together by feedthrough 12, such a soldered or plated-through via or an insulation displacement connection that extends through an opening 14 in the substrate. Outer end 16 of coil 4 is connected to one terminal 18 of a transponder circuit which is implemented on IC chip 20, while the other end 22 of other coil 6 is connected to the opposite terminal 24 of transponder circuit 20 by another feedthrough 26 that extends through a corresponding opening in substrate 2.

Graue, "Loop Antenna," U.S. Pat. No. 1,615,755 (1927) shows in FIG. 1 outer and inner series of strips or bars 22 and 23 extending transversely between sides 14 of a cabinet. Strips or bars 23 in the inner series are in radial alignment with those in the outer series. The outer edges of bars 22 and the inner edges of bars 23 are notched at 24 and 25 as best shown in FIG. 2. The notches provide for retention of the successive convolutions of the coil so that the convolutions will not slip longitudinally on the supporting bars. The coil is indicated generally at 26 and is comprised of suitable conductor wound over outer strips 22 and under inner strips 25.

Libby, "Simulating Impedance System," U.S. Pat. No. 2,448,036 (1948) shows antenna 5 in FIG. 1 connected at one end 12 of an outer conductor of coaxial line coil 11. The other end 13 of antenna 5 is coupled to the outer conductor grounded to casing 9. The counterpoise 7 is connected to the outer conductor coaxial line 10 at end 14 with the opposite end 15 being grounded.

In radio frequency identification (RFID) tags, for example operating at frequencies of 125 kHz and 27.1 MHz, the transmission is predominantly through the magnetic field rather than through the electric field as occurs at 2.5 GHz. Therefore, magnetic inductively coupled coils are preferred rather than E-field transmitting antennae. The problem with inductive coils are that they are expensive to manufacture when fabricated in a single plane.

There have been two basic means of producing inductive RFID label in the past. The first is to use a wire coil with multiple turns. The wires are typically held with some sort of adhesive to give the coil rigidity. The coils are expensive and are difficult to handle and mass automated assembly is difficult.

The second method is to pattern a spiraling coil onto a substrate, such as copper onto a thin insulating substrate. This presents a problem in that the two ends of the coil are on opposite sides of the coil. The two ends must be brought into close proximity to each other in order to connect to the chip. This can be overcome by two methods. The first is to add a second conductor which can contact one end of the spiral and make a connection in close proximity to the other end. This too is expensive as the second conductor must be placed on the back of a substrate and feedthroughs are then required or an insulator must be placed over the first conductor so that the two conductors do not short. Both options are expensive to make on a mass scale.

Another way of getting around this problem is to have bonded wires cross the spiral without touching a coil. This also is difficult, costly and very limiting to the number of turns which can be included within the coil in a mass manufactured device.

What is needed then is a two dimensional configuration for a loop antenna in a single plane which can be manufactured all on one side or surface of an integrated surface substrate so that the antenna terminals may be closely positioned to each other.

BRIEF SUMMARY OF THE INVENTION

The invention is a loop antenna comprising a substrate having a first surface and an opposing second surface. A pair of terminals is disposed on the first surface of the substrate. The terminals are positioned at a distance from each other no greater than a predetermined maximum separation, typically at 3 mm or less. A wire loop is disposed on the substrate. Each of the ends of the wire loop is coupled to a different one of the pair of terminals. The loop is disposed only on the first surface of the substrate in a serpentine pattern without being disposed through the substrate and without self-crossing, so that the length of the loop is substantially increased relative to a net area enclosed within the loop. The pair of terminals are preferably, but not necessarily, both disposed interior to said pattern.

In one embodiment the serpentine wire pattern comprises a radially interdigitated continuous loop pattern within a circular portion of the first surface. The radially interdigitated continuous loop pattern is formed from a plurality of pie-shaped loops separated by approximately uniformly spaced separations to minimize reduction of the net area while increasing total length of the wire loop.

In another embodiment the serpentine wire pattern comprises a continuous serpentine loop pattern in a rectangular portion on the surface. In one species the rectangular portion containing the serpentine loop pattern is disposed adjacent to one side of the net area. In another species of the embodiment the rectangular portion containing the serpentine loop pattern is comprised of multiple rectangular portions. Each one of which is disposed adjacent to different corresponding sides of the net area.

The first surface of the substrate is characterized by a perimeter and the serpentine wire pattern is comprised of a length of the wire from one of the pair of terminals to an opposing one of the pair of terminals between which a continuous conductive path is defined by the wire. The length is greater than the perimeter of the substrate.

In the illustrated embodiment the loop antenna is combined with a radio frequency identification tag circuit coupled to the pair of terminals.

The invention is alternatively defined as an antenna pattern for use on a single surface of an insulated substrate having a perimeter comprising a first and second conductive terminal disposed on the single surface. The first and second terminals are adjacent to each other. A serpentine wire is disposed on the first surface without crossing itself and extending from the first the second terminal to form a continuous, conductive path therebetween. The serpentine wire is disposed in a portion of the first surface having a perimeter. The serpentine wire has a length between the first and second terminals exceeding the perimeter of the portion of the surface in which it is disposed.

The invention is still further alternatively defined as an antenna pattern for with an RFID tag comprising a single insulated surface on which closely adjacent first and second conductive terminal are disposed. A wire loop is disposed on the surface in a pattern folded back on itself a plurality of times without crossing itself and extending from the first the second terminal to form a continuous. conductive path therebetween. The loop has its ends coupled to the first and second conductive terminals.

The invention, now having been briefly summarized, can be better visualized by turning to the following drawings wherein like elements are referenced by like numerals.

Figure 1:
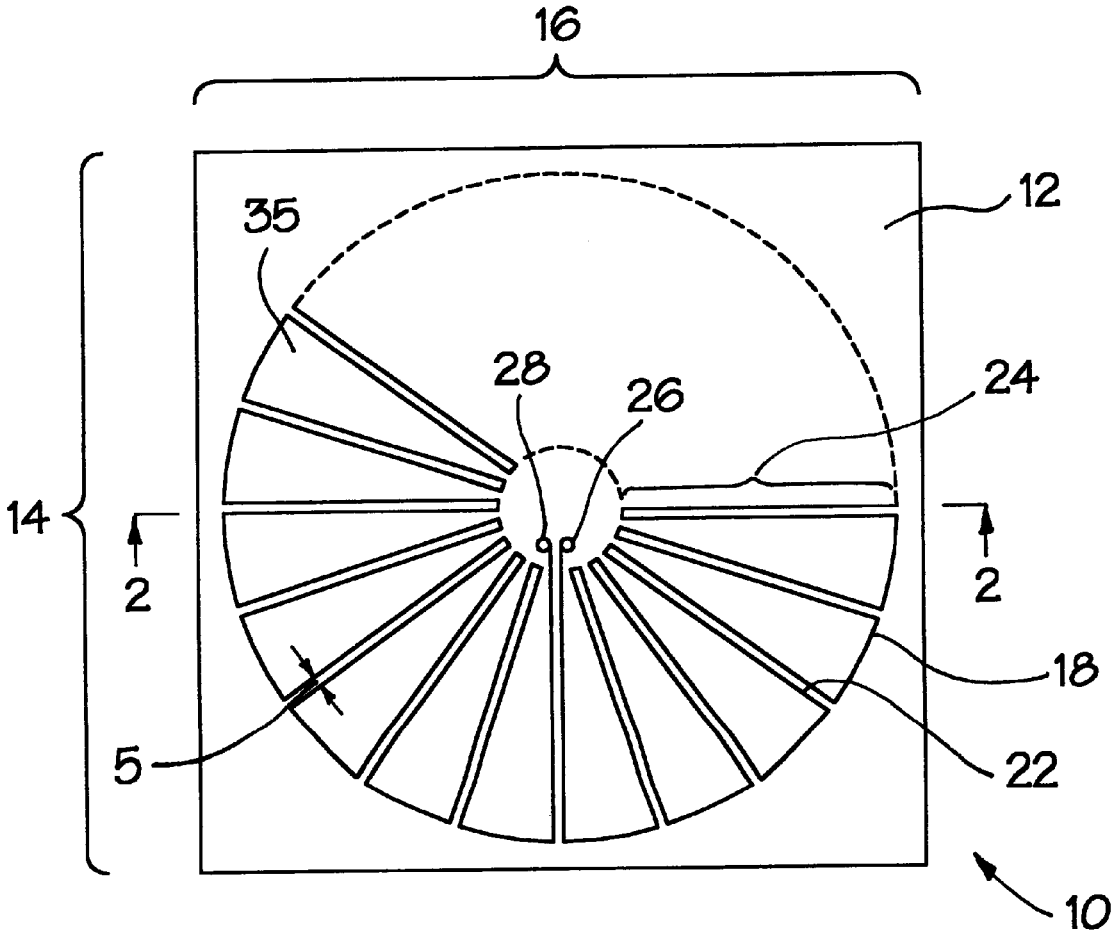
FIG. 1 is a top plan view of first embodiment of the invention.

The invention and its various embodiments may now be better understood by turning to the following detailed description in which the illustrated embodiments are set forth by way of example.

DETAILED DESCRIPTION OF PREFERRED EMBODIMENTS

A flat compact loop pattern provides an antenna for radio frequency identification tags with an enhanced voltage and/or current across two closely adjacently spaced terminals which are disposed on the same side of an insulating substrate. The amount of voltage supplied by the antenna loop to the RFID tag depends not only on the surface area included within the loop but also on the length of the planar loop or winding. The loop is comprised of a serpentine non-crossing wire disposed all on one side of the substrate, typically in the pattern of either a raster patterns in areas adjacent to one or more of the sides of the rectangular substrate, or a radial array of loops extending between the periphery and center of the substrate as the loops are azimuthally advanced around the center like spokes on a wheel or slices of pie.

The invention is directed to a better and very simple solution to the forgoing mass assembly problems. The invention is generally illustrated as a flat, single plane, serpentine coil with a long return. Since according to the invention it was recognized that passive or externally powered RFID tags are voltage limited and not power limited, it is then important to achieve as much inductance as possible inasmuch as the inductance is directly proportional to voltage. However, the inductance is a function if the wire length and is not a function of the number of turns except insofar as a coil inductor with more turns has a longer wire length. The only reason for multiple turns on a coil is that a given wire length is being sought with a given overall size coil. This dictates a multiple number of turns.

The electromagnetic equation which is applicable is:

$$\oint \vec{H} \cdot d\vec{l} = I + \int \frac{\partial \vec{D}}{\partial t} \cdot d\vec{S}$$

where the line integral on the magnetic field vector, H, is taken on the boundary, dl, of the enclosed surface, S, where D is the electric displacement vector, I is the current flowing through the surface S, and t is time. The current induced in the loop of wire is equal to the closed contour integral of the inner product of magnetic field vector with the loop boundary minus the inner product of the partial time derivative of the electrical displacement vector over the surface of the loop. The smaller the enclosed area of the loop, the larger the induced current. The current and hence the voltage output across terminals 26 and 28 is thus increased by increasing the length of the loop as the enclosed area is reduced.

A high inductance can be achieved by having only one loop within a small area by forming the loop with a serpentine pattern around its entire perimeter. For example, a single square loop which is one inch on a side has a length of four inches. The same outer perimeter of a one inch square with a serpentine path extending inward by 0.185 inch on each side has a total length of over 60 inches when formed with 5 middle lines and spaces. In other words, the lo inductance has increased by a factor of 15 while maintaining a flat, single surface, inductor coil with the two ends of the coil being adjacent. The cost of such coil is the same as forming a single sided coil of only one turn, namely, the minimum and it present no more difficulty in handling during mass assembly than a simple single loop flat antenna.

FIG. 1 is a top plan view of an antenna assembly, generally denoted by reference 10 of the first embodiment of the invention. Antenna assembly 10 is comprised of a insulating substrate 12 chosen from the type of material typically used for printed circuit boards, such as any kind of phenolic, plastic, glass fiber or other insulating substrate now known or later devised. In the illustrated embodiment board 12 is shown as a generally rectangular piece having a length 14 of approximately 10 to 50 mm and a width 16 of 10 to 50 mm. The dimensions are not critical to the invention and are set forth only as an illustration to provide a concrete context in which the size of assembly 10 can be understood. Since antenna assembly 10 is used in integrated circuit RF identification tags, it must be small enough to be encapsulated within the RFID tag packaging which is typically no greater than 60 by 60 by 0.5 mm in its overall envelope. Thickness 32 of substrate 12 is typically 0.5 to 0.2 mm. Although any thickness consistent with the present teachings may be employed. Moreover, although substrate 12 is described as a rigid substrate, the use of flexible or curved substrates are all so expressly contemplated. The thickness and two dimensional spatial extent is minimized.

Figure 2:
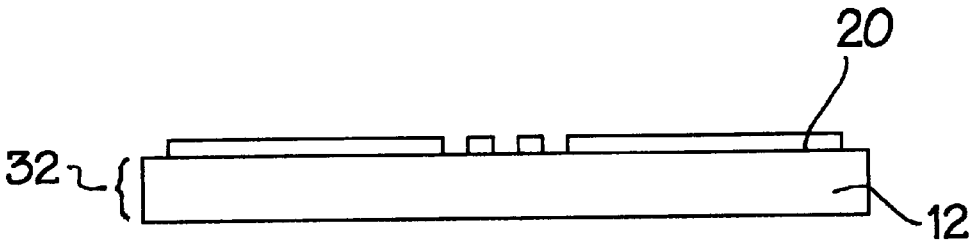
FIG. 2 is a cross-sectional view of the embodiment of FIG. 1 taken through lines 2—2 of FIG. 1.

Antenna assembly 10 includes an antenna pattern 14 formed on an upper surface 20 of board 12 as best shown in FIG. 2. Antenna pattern 18 is made from conventional printed circuit wiring 22 disposed on surface 20 such as plated or deposited copper. In FIG. 1 antenna pattern 18 is shown as a circular envelope or pattern with serpentine or interdigitated radial loops 24 in the circular envelope. Radial loops 24 extend from the center portion of substrate 20 toward the outer limit of the circular envelope and then back toward the center portion of substrate 20. Antenna pattern 18 is provided with center terminals 26 and 28 disposed on surface 20. Contact is then made directly with an integrated circuit chip (not shown) mounted on or coupled to center terminals 26 and 28. Wiring 22 then extends from terminal 26 in a serpentine repetition of loops 24 in a circular path across surface 20 of substrate 12 to finally terminate in the adjacent terminal 28. The distance between terminals 26 and 28 are typically 1 mm or less to allow their economic, and convenient integration or coupling to an RFID circuit chip. The means of connection between terminals 26 and 28 in the RFID circuit chip (not shown) may be affected by any means now known or later devised in the art, such as wire bonding or conductive paste.

Furthermore, it is to be expressly understood that the position of terminals 26 and 28 may be varied according to the requirements put upon antenna assembly 10 by the RFID circuit chip. Thus, terminals 26 and 28 need not be within the center or eye of pattern 18. It is also contemplated that terminals 26 and 28 could also be provided at any location on surface 20, including on or near one of its sides 14 or 16. However, one of the advantages of the invention is that terminals 26 and 28 are disposed on the same side 20 of substrate 12 so that no through vias, insulated cross wirings or bonds are required. There is no crossing of wires 22 with any portion of radial loops 24 so that no insulation between wires 22 and the various loops 24 are required. The fabrication of antenna assembly 10 is thus economical and simplified while at the same time providing a substantially increased length of wire 22 over that realized by simple circular loop antenna which typifies the prior art. For example, a circular envelope of 20 mm in diameter has a wire length of 6.3 mm, but a serpentined circular loop as shown in the embodiment of FIG. 1 with a wire thickness of 0.05 mm and a wire separation of 0.05 mm has a wire length of 382 mm. The reduction of the area interior to the loop or net area 35 is minimized by making the loops pie shaped. Each loop 11 is separated from the adjacent loop 11 by a uniform or nearly equidistant separation 15, which is set at the minimum practical inter-wire separation according to the fabrication methods used. The exterior area 13 outside of the loop pattern is thus minimized while the total length of the wire making the loops is substantially increased.

Figure 3:
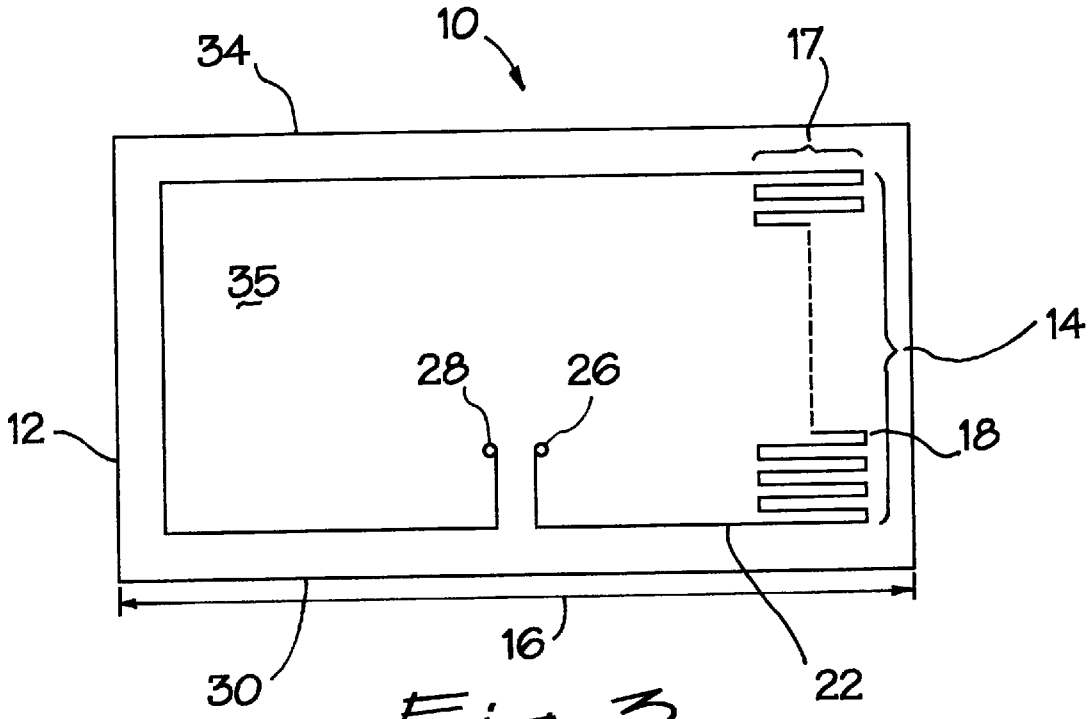
FIG. 3 is a top plan view of a second embodiment of the invention.

FIG. 3 is a top plan view of a second embodiment of antenna assembly 10 in which antenna wires 22 are laid in an antenna pattern 18 which is in the form of a single serpentine horizontal rastered column stacked from the bottom of substrate 12 as illustrated in FIG. 3 and winding back and forth horizontally across digit width 17 of substrate 12 to the top of its vertical length 14. Clearly the looping raster could be just as easily formed in a horizontal orientation in FIG. 3 as vertical. A long section 34 of wire 22 provides the return path from the top of substrate 12 to terminal 28 on the bottom edge 30 of substrate 12. With a wire width of 0.05 millimeters and a wire separation of 0.05 mm, the length of serpentine wire 22 in pattern 18 of FIG. 3 is at least 25 times greater than if a single rectangular loop were employed on the same sized substrate 12. Again, Is the no three hole vias or overlying insulation required for the pattern 18 of FIG. 3 which may be fabricated using a single layer of metalization disposed directly upon surface 20 of substrate 12. The embodiment of FIG. 3 encloses an area 35 which is interior to pattern 18 on substrate 12 to form a net enclose area. The net area determines the amount of flux captured.

Figure 4:
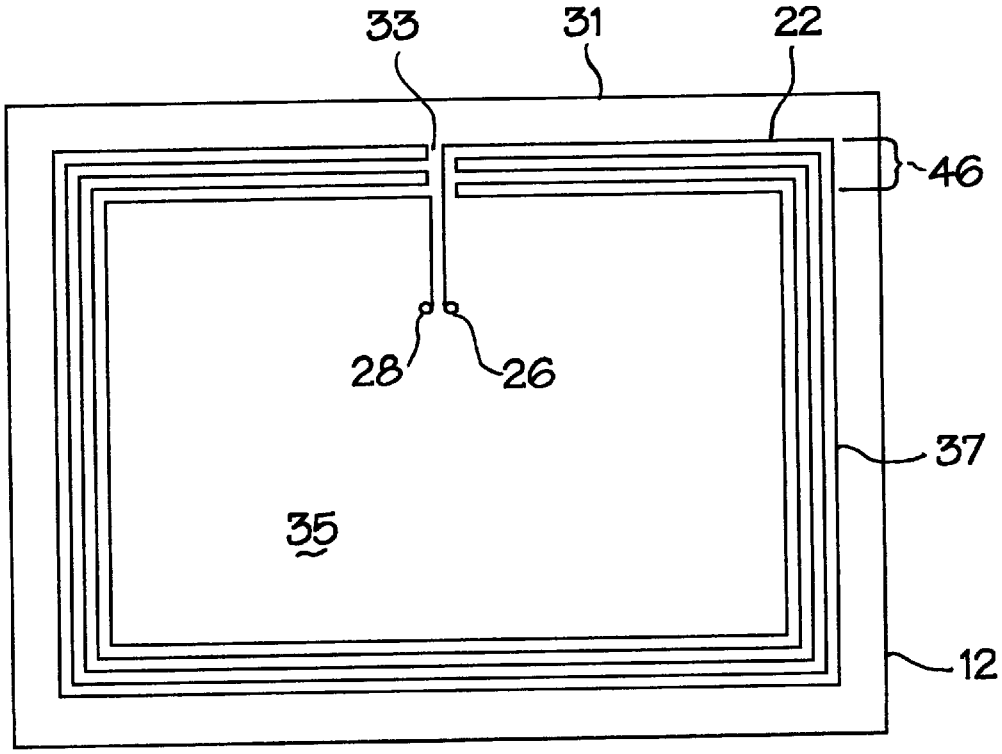
FIG. 4 is a top plan view of a third embodiment of the invention.

A third embodiment of antenna assembly 10 is shown in the top plan view of FIG. 4. In this embodiment wire 22 is led from both terminals 26 and 28 in a multiple, peripheral serpentine loops 37 starting on the outside edge 31 of pattern 18 substrate 12 and repeatedly looping around the periphery in a nested coil pattern to the top center 33 is reached and then reversing, until a predetermined number of loops 37 have been made. As illustrated in FIG. 4 five tracks of wire 22 are laid down to make peripheral loops 37 which wire 22 makes a connection to center terminals 26 and 28 which are inside the pattern of the peripheral loops. The net area 35 is interior to loops 37 and is approximately comparable to the pattern of FIG. 3 in magnitude although the length of wire 22 is considerably longer.

Figure 5:
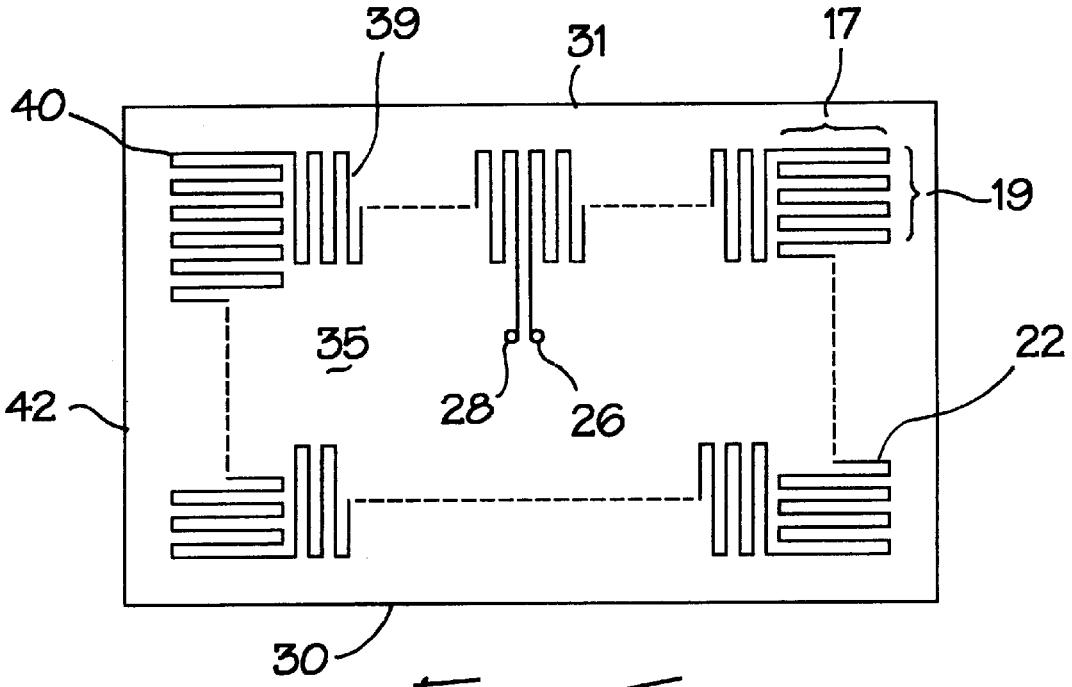
FIG. 5 is a top plan view of a fourth embodiment of the invention.

FIG. 5 illustrates a top plan view of yet another embodiment of the invention in which the interdigitated vertical pattern 18 of FIG. 3 is repeatedly vertically across a digit length 19 as well as horizontally across digit length 17.

Again the total length of wire 22 is substantially increased over the pattern of FIG. 3 and the net area 35 is decreased only by the rectangular area devoted to the interdigitated loops 39 in digit width 19 along the top and bottom sides 30 and 31 of substrate 12 and the additional rectangular area devoted to the interdigitated loops 40 of digit width 17 along the left side 42 of substrate 12 as illustrated in FIG. 5.

Figure 6:
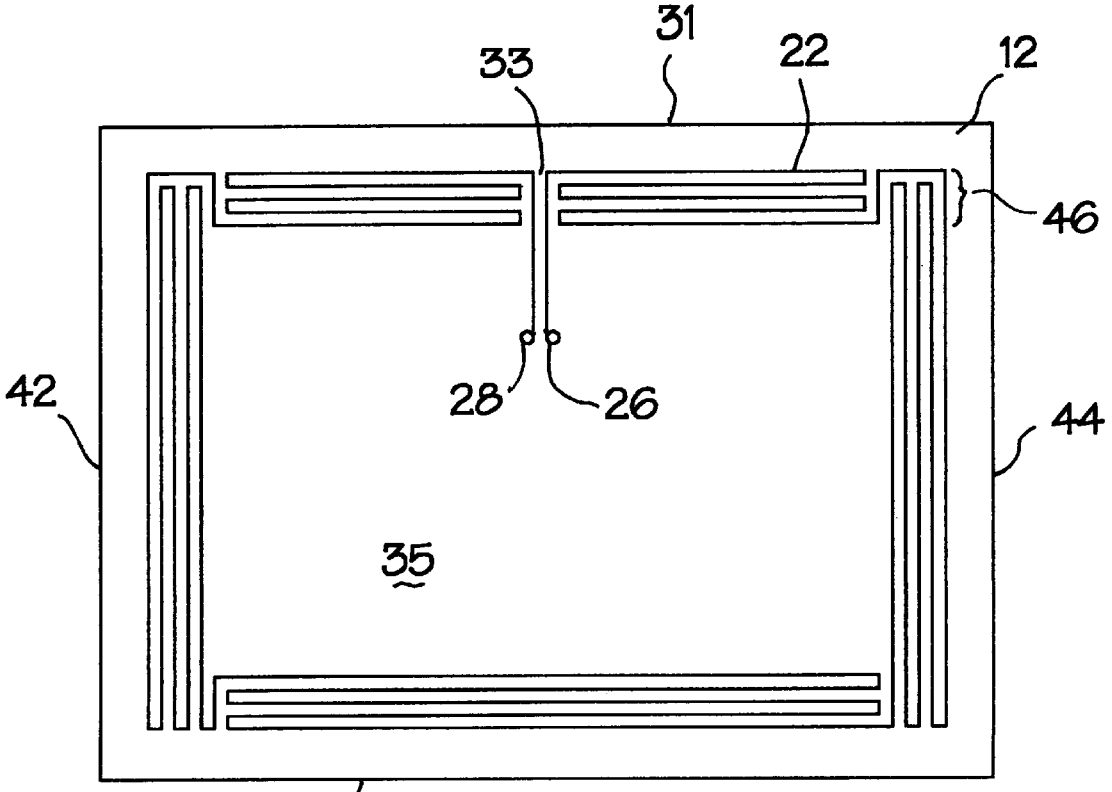
FIG. 6 is a top plan view of a fifth embodiment of the invention.

The embodiment of FIG. 6 is similarly a generalization of pattern 13 of FIG. 4. In the embodiment of FIG. 6 the five tracks of wire 22 are laid down in track 20 width 46 along each side 30, 31, 42 and 44 of substrate 12 to complete a loop segment on each side. For example, the five tracks of wire 22 are placed adjacent to the right half portion of top side 31 of substrate 12 and then connected to the five tracks of wire 22 formed adjacent to right side 44 of substrate 12. Similarly, the five tracks of wire 22 adjacent to right side 44 of substrate 12 then lead to the five tracks of wire 22 adjacent to bottom side 30 of substrate 12 , and so forth until completing the five tracks of wire 22 adjacent to the left half portion of top side 31 of substrate 12 in FIG. 6. Net area 35 is approximately comparable to the pattern of FIG. 4 as is the total wire length. However, because of the difference in topology of the two patterns of FIGS. 4 and 6 the self-inductance and other electrical characteristics of antenna 10 will be slightly different. Antenna 10 of FIG. 4 having an outside dimension of one inch has an inductance of 500 nH as compared to 150 nH that would be achieved by a single peripheral rectangular loop. The inductance of antenna 10 of FIG. 6 is 500 nH.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims.

The words used in this specification to describe the invention and its various embodiments are to be understood not only in the sense of their 20 commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

I claim:

1. A loop antenna comprising:

a substrate having a first surface and an opposing second surface, and a peripheral area;

a pair of terminals disposed on said first surface of said substrate, said terminals being positioned at a distance from each other no greater than a predetermined maximum separation; and a continuous wire loop having two ends and a length between said two ends, each of said ends coupled to a different one of said pair of terminals, said conductive loop being disposed only on said first surface of said substrate in a serpentine pattern, without being disposed through said substrate and without self-crossing, so that said length of said loop is increased multiple times relative to a net fixed area enclosed within said loop, said serpentine pattern forming multiple coiled subloops in and substantially filling at least a portion of said peripheral area of said substrate.

2. The loop antenna of claim 1 wherein said serpentine wire pattern comprises a radially interdigitated continuous loop pattern within a circular portion of said first surface, said radially interdigitated continuous loop pattern being formed from a plurality of pie-shaped loops separated by approximately uniformly spaced separations to minimize reduction of said net area while increasing total length of said wire loop.

3. The loop antenna of claim 1 wherein said serpentine wire pattern comprises a continuous serpentine loop pattern in a rectangular portion on said surface.

4. The loop antenna of claim 3 wherein said rectangular portion containing said serpentine loop pattern is disposed adjacent to one side of said net area.

5. The loop antenna of claim 3 wherein said rectangular portion containing said serpentine loop pattern is comprised of multiple rectangular portions, each one of which is disposed adjacent to different corresponding sides of said net area.

6. The loop antenna of claim 1 wherein said pair of terminals are both disposed interior to said pattern.

7. The loop antenna of claim 1 wherein said first surface of said substrate is characterized by a perimeter and wherein said serpentine wire pattern is comprised of a length of said wire from one of said pair of terminals to an opposing one of said pair of terminals between which a continuous conductive path is defined by said wire, said length being greater than said perimeter of said substrate.

8. The loop antenna of claim 1 further being combined with a radio frequency identification tag circuit coupled to said pair of terminals.

9. An antenna pattern for use on a single surface of an insulated substrate having a perimeter comprising:

a first and second conductive terminal disposed on said single surface, said first and second terminals being adjacent to each other and separated by not more than a pre-determined maxim separation distance; and a continuous serpentine wire disposed on said surface without crossing itself and extending from said first to said second terminal to form a continuous, conductive path there between, said surface having a perimeter, said serpentine wire having a length between said first and second terminals exceeding said perimeter of said substrate, said serpentine wire forming multiple coiled subloops in and substantially filling at least one peripheral area of said substrate included within said perimeter.

10. The antenna pattern of claim 9 wherein said portion of said first surface is rectangular and said serpentine wire disposed on said single surface in said rectangular portion is a raster pattern.

11. The antenna pattern of claim 10 wherein said raster pattern is disposed along two or more sides of said portion.

12. The antenna pattern of claim 9 wherein said single surface has a center and a periphery, and wherein said serpentine wires are disposed on said single surface by repeatedly radially extending from said periphery towards said center and returning in a loopwise fashion towards said periphery while advancing azimuthally around said center until reaching said second terminal.

13. The antenna pattern of claim 10 wherein said serpentine wire is continuous and non-crossing while self-interdigitated to maximize length of said wire within a constant planar envelope.

14. An antenna pattern for with an RFID tag comprising:

a single surface with an insulated surface, said single surface having at least one peripheral area;

closely adjacent first and second conductive terminal disposed on said insulated surface; and a continuous wire loop disposed on said surface in a pattern folded on itself a plurality of times without crossing itself and extending from said first said second terminal to form a continuous, conductive path therebetween, said loop having two opposing ends, said ends being coupled to said first and second conductive terminals, said pattern forming multiple coiled sub-loops in and substantially filling said at least one peripheral area.

15. The antenna pattern of claim 14 wherein said pattern is a notched circular loop.

16. The antenna pattern of claim 14 wherein said pattern is a notched rectangular loop.

17. The antenna pattern of claim 14 wherein said pattern is a rectangular, multiply layered, peripheral raster pattern.

18. The antenna pattern of claim 14 wherein said pattern is arranged and configured by serpentine folding to increase the length of said wire loop with minimal reduction in area interior to said wire loop.

19. The antenna pattern of claim 14 wherein said pattern has a length from first to second conductive terminal and wherein said length is more than the perimeter of said insulated surface.

* * * * *